US006840185B2

(12) United States Patent
Tamai

(10) Patent No.: US 6,840,185 B2
(45) Date of Patent: Jan. 11, 2005

(54) METHOD AND SYSTEM FOR PREVENTING THREAD BREAKAGE

(75) Inventor: Hirofumi Tamai, Osaka-Fu (JP)

(73) Assignee: Muscle Corporation, Osaka (JP)

( * ) Notice: Subject to any disclaimer, the term of this patent is extended or adjusted under 35 U.S.C. 154(b) by 0 days.

(21) Appl. No.: 10/681,383

(22) Filed: Oct. 9, 2003

(65) Prior Publication Data

US 2004/0129191 A1 Jul. 8, 2004

(30) Foreign Application Priority Data

Nov. 15, 2002 (CA) ..... 2411955

(51) Int. Cl.[7] ..... D05B 21/00; D05C 5/02
(52) U.S. Cl. ..... 112/475.19; 112/102.5
(58) Field of Search ..... 112/475.19, 102.5, 112/470.06, 453, 454, 456, 458, 302, 308

(56) References Cited

U.S. PATENT DOCUMENTS

| | | | | |
|---|---|---|---|---|
| 1,129,588 | A | | 2/1915 | Onderdonk |
| 1,548,464 | A | | 8/1925 | Hemleb |
| 2,173,320 | A | | 9/1939 | De Voe |
| 3,083,661 | A | | 4/1963 | Patrick |
| 3,476,067 | A | | 11/1969 | Johnson |
| 3,587,495 | A | | 6/1971 | Johnson |
| 3,877,405 | A | | 4/1975 | Dorosz et al. |
| 4,215,641 | A | | 8/1980 | Dobrjanskyj et al. |
| 4,269,131 | A | | 5/1981 | Principe |
| 4,301,757 | A | | 11/1981 | Tonomura |
| 4,320,712 | A | | 3/1982 | Johnson |
| 4,503,788 | A | | 3/1985 | Giannuzzi et al. |
| 4,506,612 | A | * | 3/1985 | Yanagi ..... 112/102.5 |
| 4,526,117 | A | * | 7/1985 | Willenbacher ..... 112/308 |
| 4,582,968 | A | | 4/1986 | Huber et al. |
| 4,590,879 | A | | 5/1986 | Matsubara et al. |
| 4,616,583 | A | | 10/1986 | Takano et al. |
| 4,690,083 | A | | 9/1987 | Hara et al. |
| 4,706,589 | A | | 11/1987 | Tsukioka |
| 4,949,657 | A | | 8/1990 | Hanyu et al. |
| 5,311,439 | A | | 5/1994 | Hayakawa et al. |
| 5,315,945 | A | | 5/1994 | Nakano |
| 5,319,565 | A | | 6/1994 | Hausammann et al. |
| 5,320,054 | A | | 6/1994 | Asano |
| 5,410,976 | A | | 5/1995 | Matsubara |
| 5,520,126 | A | | 5/1996 | Muto et al. |
| 5,543,005 | A | | 8/1996 | Monget et al. |
| 5,648,908 | A | | 7/1997 | Chirn et al. |
| 5,899,154 | A | | 5/1999 | Mizuno |
| 5,931,107 | A | | 8/1999 | Thrash et al. |
| 6,198,983 | B1 | | 3/2001 | Thrash et al. |
| 6,293,210 | B1 | | 9/2001 | Freeman et al. |

FOREIGN PATENT DOCUMENTS

| | | |
|---|---|---|
| CA | 1058451 | 7/1979 |
| CA | 1198018 | 12/1985 |

* cited by examiner

*Primary Examiner*—Peter Nerbun

(57) ABSTRACT

A method for minimizing contact between a needle point and a needle thread in a computer controlled embroidery machine, to prevent breakage of the needle thread by the needle point upon penetration of a workpiece during stitching. The method includes the steps of: determining a first straight path between a current needle penetration location and a next needle penetration location; and, moving to the next needle penetration location along a second non-straight path so that the needle thread is pulled away from the needle point.

18 Claims, 10 Drawing Sheets

PRIOR ART

PRIOR ART

METHOD AND SYSTEM FOR PREVENTING THREAD BREAKAGE

This application claims priority from Canadian Patent Application No. 2,411,955, filed Nov. 15, 2002, the disclosure of which is incorporated herein by reference.

FIELD OF THE INVENTION

The invention relates to the field of embroidery machines, and more specifically, to a system and method for reducing thread breakage due to needle puncture during the embroidery process.

BACKGROUND OF THE INVENTION

Industrial high-speed embroidery machines generally have a workpiece support table which is mounted for movement along several axes relative to a needle carrying sewing head. The support table is driven by stepper motors which are responsive to signals from a computer control system. The signals are generated according to a digitized pattern. The workpiece is then moved under the sewing instruments through a desired path.

Typically, the sewing head includes a drive shaft to vertically reciprocate a swingable needle to penetrate a fabric to be embroidered and also to reciprocate a thread take-up lever to supply an upper thread from a supply and to tighten a stitch to be formed.

Thread breakage is a significant problem in high speed embroidering systems. It is estimated that thread breakage occurs once every few minutes in a 1000 stitch per minute machine. Effective upper thread tension control is considered important to achieving accurate stitching. If the upper thread tension is not properly controlled prior to needle penetration, thread breakage can occur. In particular, if there is too much slack in the upper thread, thread can wrap around the point of the needle, prevent loop seizure, break the thread, or interfere with correct stitch formation.

Several devices are known for controlling upper thread tension and hence for preventing thread breakage, as for example U.S. Pat. Nos. 4,320,712, 4,590,879 and 4,616,583.

Other systems for reducing thread breakage function by controlling the position of the needle thread relative to the descending needle to avoid contact between the two. For example in U.S. Pat. No. 4,706,589 to Tsukioka, a needle thread guide is disclosed for a button holing sewing machine. The needle thread guide is provided at the needle bar frame and located adjacent to the needle entry protects the needle thread from being struck by the needle when the workpiece is fed during button holing. The guide guides the needle thread outwardly when the needle descends, thus the needle thread positioned lower than the needle eye is protected from being struck by the needle. The guide is associated with the oscillating motion of the needle, but its direction of oscillation is opposite to the direction of needle oscillation, and its amplitude is almost twice the amplitude of the needle. A similar thread deflection device for zigzag stitching is disclosed in U.S. Pat. No. 4,949,657 to Hanyu, et al.

One shortcoming of these devices is that their mechanics limit their ability to effectively adapt to varying stitch and workpiece characteristics prevalent in modem high speed automated embroidery machine applications.

A need therefore exists for an improved method and system for reducing thread breakage due to the needle contacting the needle thread as it penetrates the fabric and that allows for the effective adaptation to varying stitch and workpiece characteristics and that is not limited by sewing machine mechanics.

SUMMARY OF THE INVENTION

The invention provides a method of preventing needle thread breakage between the needle and workpiece of an automated embroidery machine system by introducing an indirect path between a first needle penetration point and a next needle penetration point in the workpiece. The characteristics of the indirect path are determined by a sequence of instructions stored in the data processing system associated with the automated embroidery machine system. An advantage of the present invention is that it requires minimal or no modification of existing automated embroidery machine mechanics.

According to one aspect of the invention, a method is provided for minimizing contact between a needle point and a needle thread in a computer controlled embroidery machine, to prevent breakage of the needle thread by the needle point upon penetration of a workpiece by the needle during stitching. The method includes the steps of: determining a first straight path between a current needle penetration location and a next needle penetration location; and, moving to the next needle penetration location along a second non-straight path so that the needle thread is pulled away from the needle point.

Preferably, the method further includes the steps of: determining a probability of needle thread breakage for the first straight line path; and, selecting said second non-straight path if the probability is within a predetermined range.

Preferably, the shape of the second non-straight path is variable. Preferably, the shape of the second non-straight path includes sinusoids, curves, arcs, and straight lines. Preferably, the shape is modified in response to variables including thread tension, thread strength, thread diameter, stitch length, workpiece thickness, workpiece material, sewing speed, acceleration, speed of movement, and the distance between the needle point and the workpiece.

BRIEF DESCRIPTION OF THE DRAWINGS

The invention may best be understood by referring to the following description and accompanying drawings which illustrate the invention. In the drawings.

DETAILED DESCRIPTION OF THE PREFERRED EMBODIMENTS

Figure 1A:
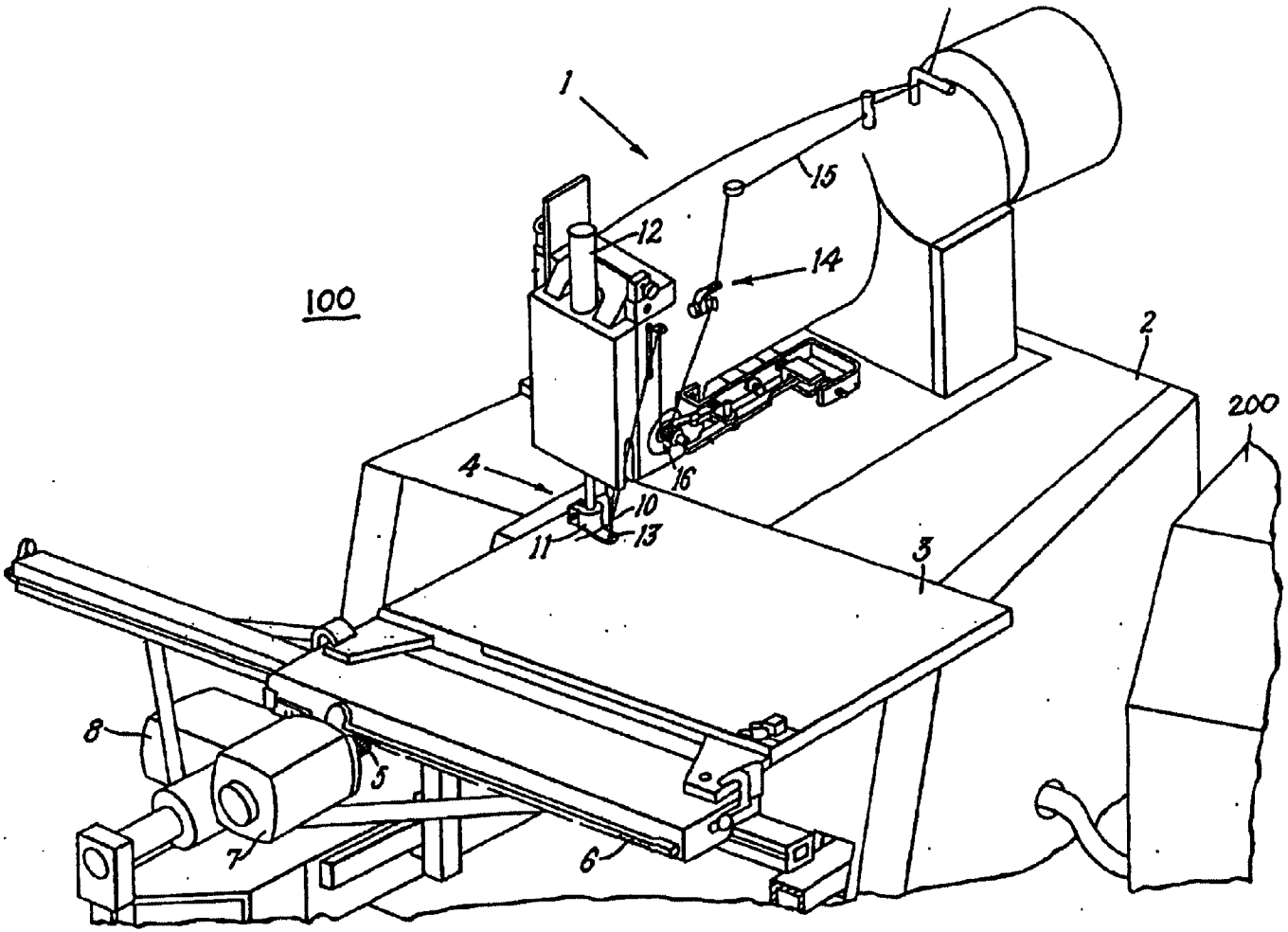
FIG. 1A PRIOR ART
FIG. 1A is a perspective view illustrating a first automated embroidery machine system in accordance with the prior art.

In the following description, numerous specific details are set forth to provide a thorough understanding of the invention. However, it is understood that the invention may be practiced without these specific details. In other instances, well-known software, circuits, structures and techniques have not been described or shown in detail in order not to obscure the invention. The term data processing system is used herein to refer to any machine for processing data, including the computer and control systems described herein. In the drawings, like numerals refer to like structures or processes.

Referring to FIG. 1A, there is shown a perspective view illustrating a first automated embroidery machine system in accordance with the prior art. In FIG. 1A, the automated embroidery machine system is shown generally by the numeral 100. The automated embroidery machine system 100 includes an embroidery machine 1 mounted on a plateform 2 in operative association with a movable workpiece support table 3. The workpiece support table 3 is moved under the stitching instruments 4 along tracks 5 and 6 by stepping motors 7 and 8. Data processing system 200 generates signals to activate motors 7 and 8 to move workpiece support table 3 through a path determined by a digitized embroidery pattern which is input to data processing system 200. The stitching instruments 4 generally consist of needle 10, presser foot 11, thread feed 14, and a bobbin assembly (not shown) located underneath the workpiece support table 3. Presser foot 11 is reciprocated by a cam in timed relation with needle 10 and may be retracted at the end of the sewing operation by air cylinder 12. Generally, presser foot 11 has an opening 13 through which needle 10 passes during the stitching operation. Thread feed 14 consists of a variety of eyes and pulleys and generally guides thread 15 from a supply spool (not shown) through a variable tension device 16 to the needle 10.

Figure 1B:
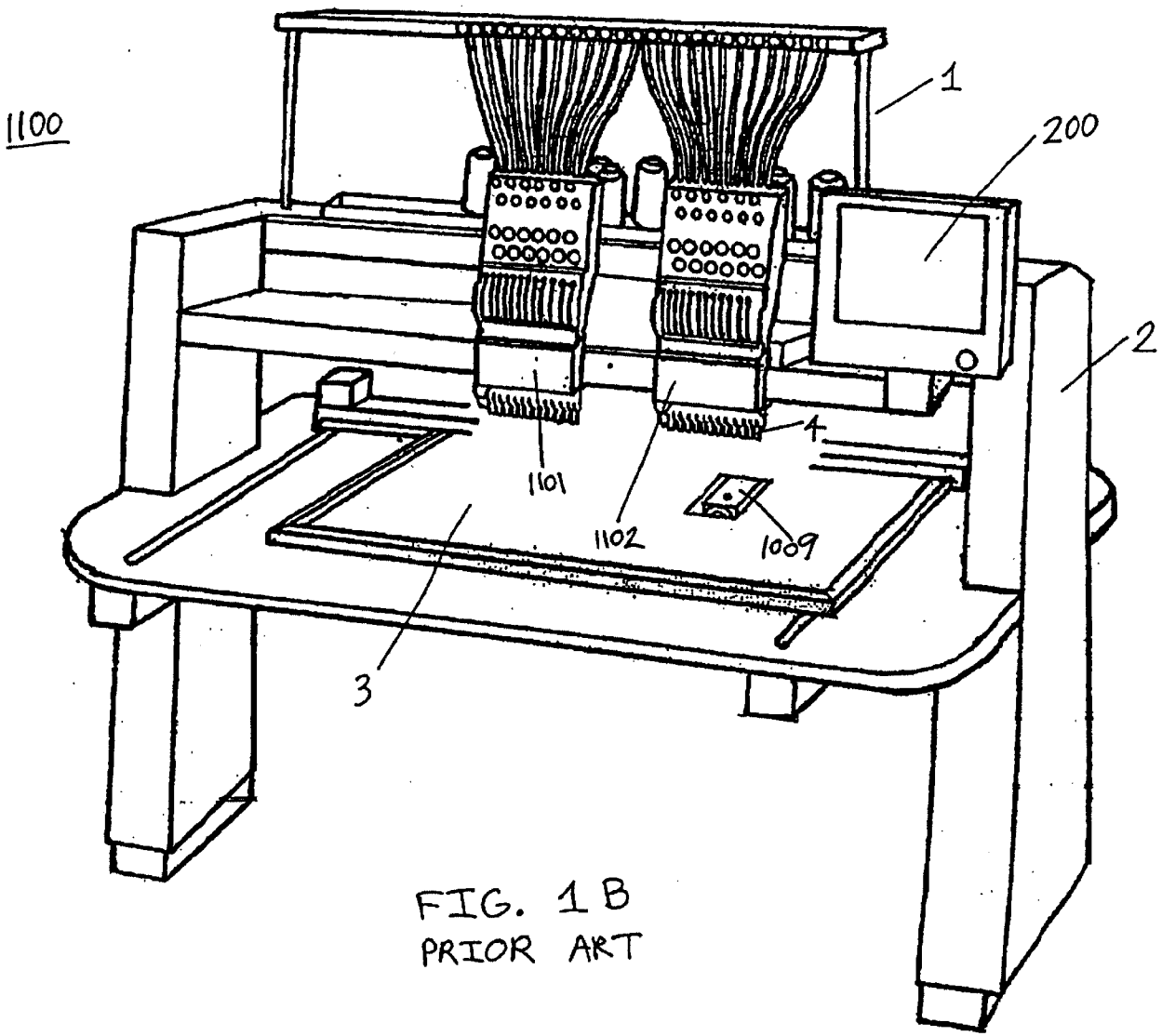
FIG. 1B PRIOR ART
FIG. 1B is a perspective view illustrating a second automated embroidery machine system in accordance with the prior art.
Figure 1C:
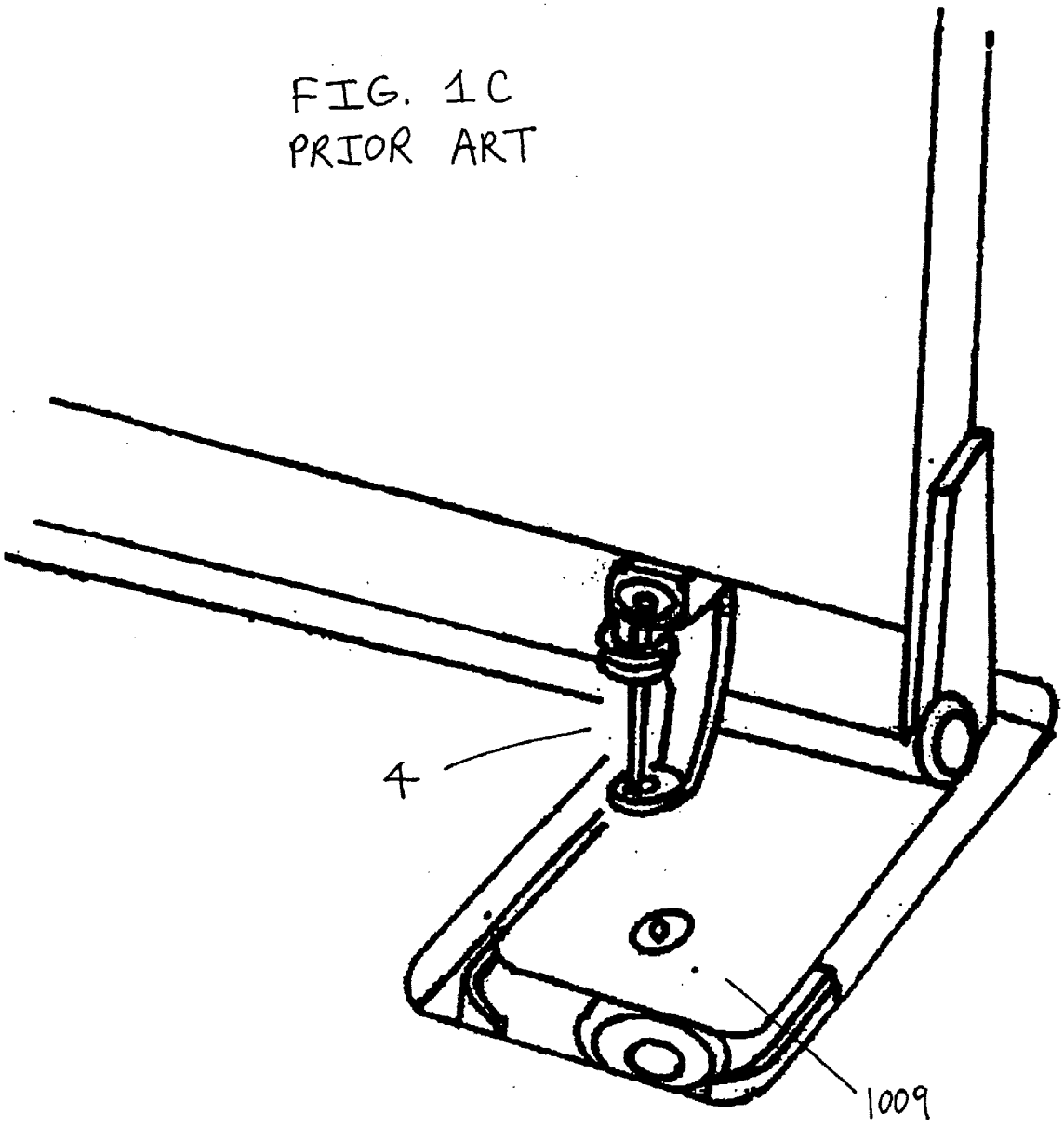
FIG. 1C PRIOR ART
FIG. 1C is a perspective detail view illustrating the stitching instruments and bobbin assembly of the automated embroidery machine system of FIG. 1B.
Figure 1D:
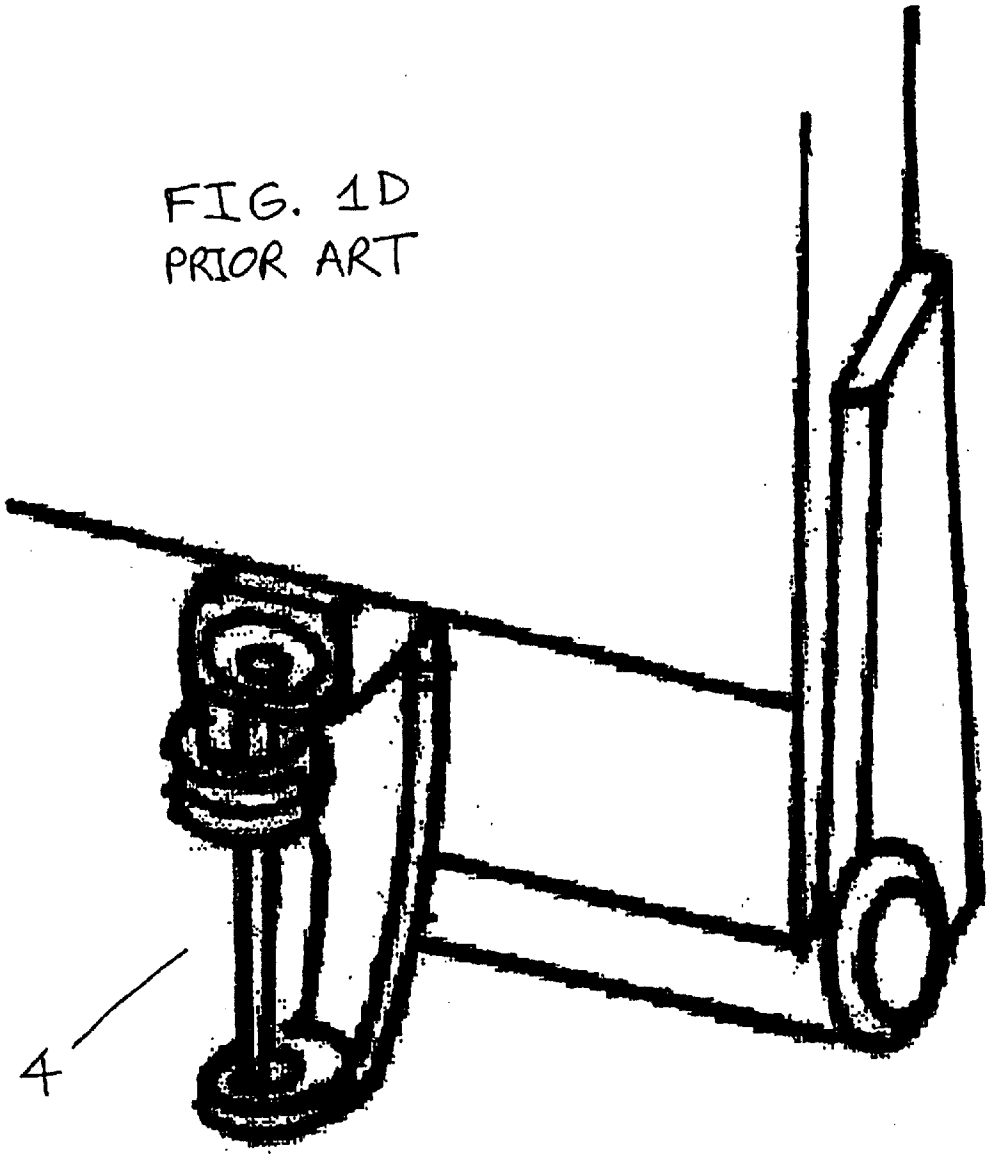
FIG. 1D PRIOR ART
FIG. 1D is a perspective detail view illustrating the stitching instruments of the automated embroidery machine system of FIG. 1B.

Referring to FIG. 1B, there is shown a perspective view illustrating a second automated embroidery machine system 1100 in accordance with the prior art. In addition, FIGS. 1C and 1D are perspective detail views illustrating the stitching instruments 4 and bobbin assembly 1009 and the stitching instruments 4, respectively, of the automated embroidery machine system 1100 of FIG. 1B. Rather than using tracks 4, 6 and stepping motors 7, 8, the second automated embroidery machine system 1100 may use more modern linear or servo motors. In addition, the second automated embroidery machine system 1100 may use multiple stitching instrument heads 1101, 1102, each containing multiple stitching instruments 4, along with tensioners including eyes, pulleys, and guides.

Figure 2:
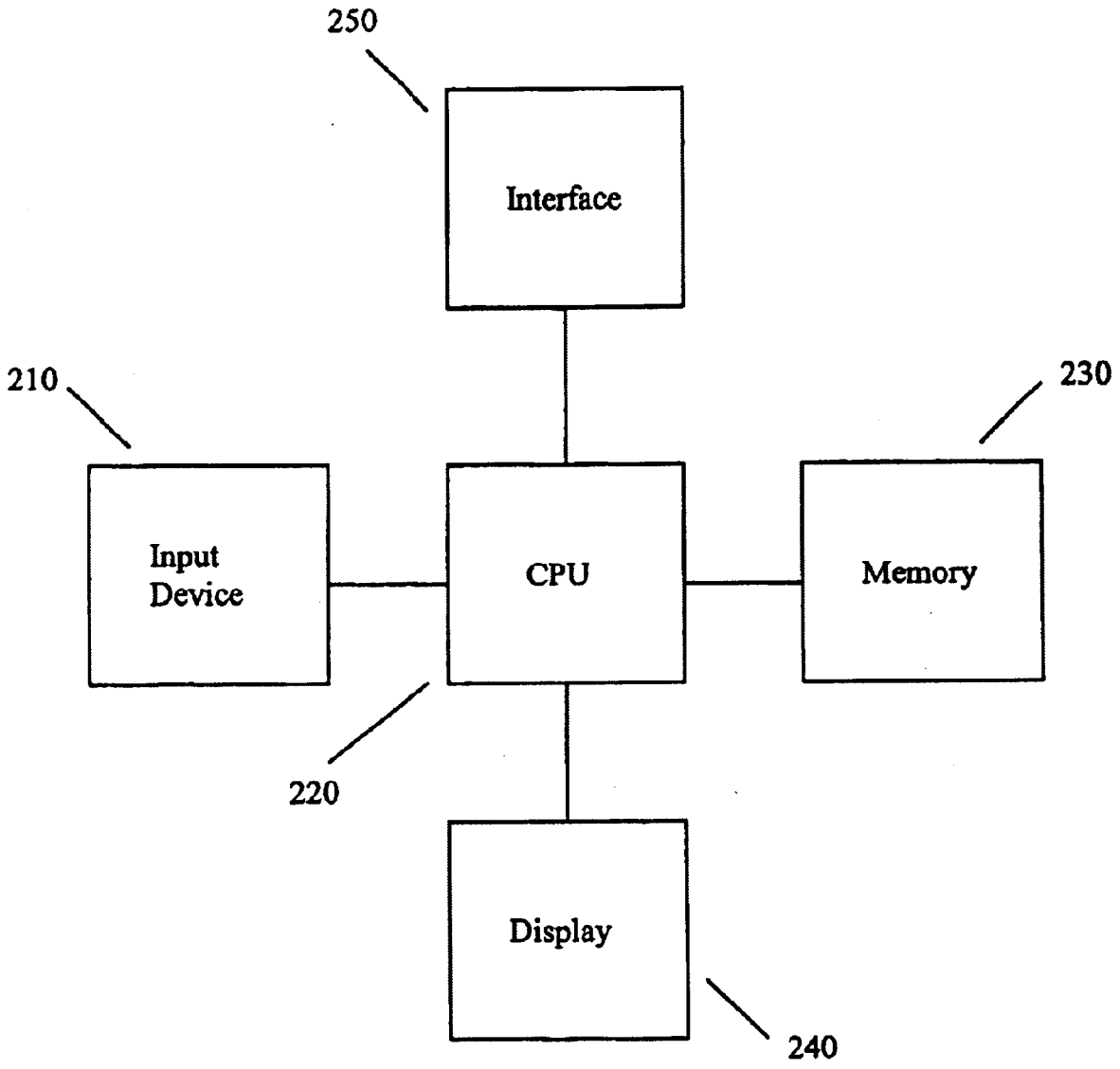
FIG. 2 is a block diagram of an exemplary data processing system for implementing the invention according to one embodiment.

Referring to FIG. 2, there is shown a block diagram of an exemplary data processing system for implementing the invention according to one embodiment. In FIG. 2, the exemplary data processing system is shown generally by the numeral 200. The data processing system 200 includes an input device 210, a central processing unit or CPU 220, memory 230, a display 240, and an embroidery machine interface 250. The input device 210 may be a keyboard, mouse, trackball, or similar device. The CPU 220 may include dedicated coprocessors and memory devices. The memory 230 may include RAM, ROM, databases, or disk devices. The display 240 may include a computer screen or terminal device. And, the embroidery machine interface 250 may include inputs and outputs for receiving and sending data and commands to and from the embroidery machine 1 and its stepping motors 7 and 8. The data processing system 200 has stored therein data representing sequences of instructions which when executed cause the method described herein to be performed. Of course, the data processing system 200 may contain additional software and hardware a description of which is not necessary for understanding the invention.

Figures 3A, 3B:
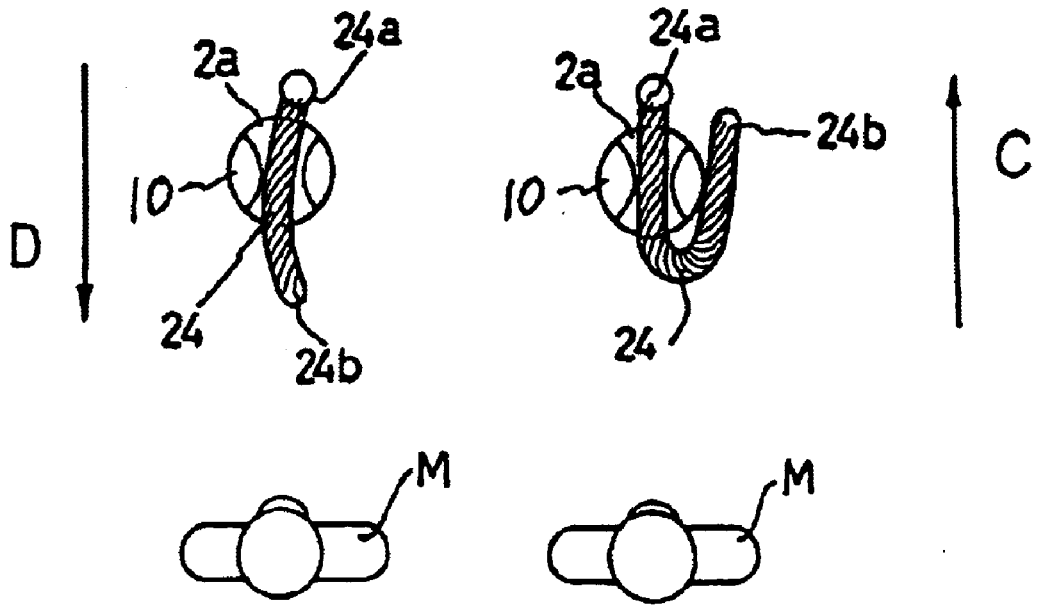
FIGS. 3A and 3B are top views illustrating the positional relationship between needle thread, needle eye, direction of threading into the needle eye, and the position of an operator in accordance with the prior art.
Figure 3C:
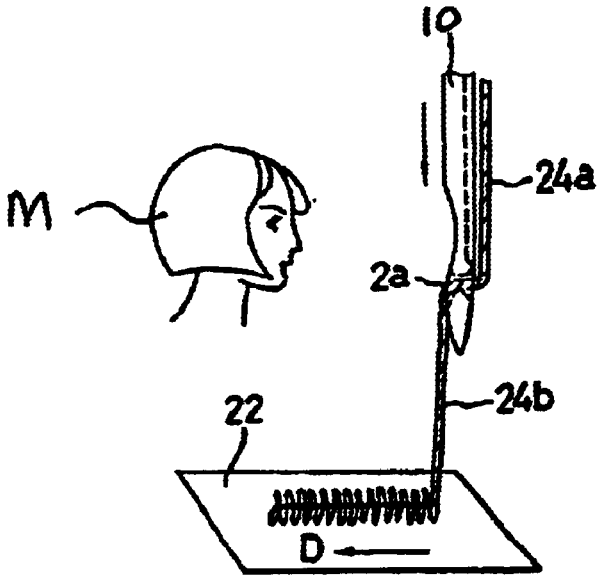
FIGS. 3C and 3D are side views corresponding to FIGS. 3A and 3B, respectively.
Figure 3D:
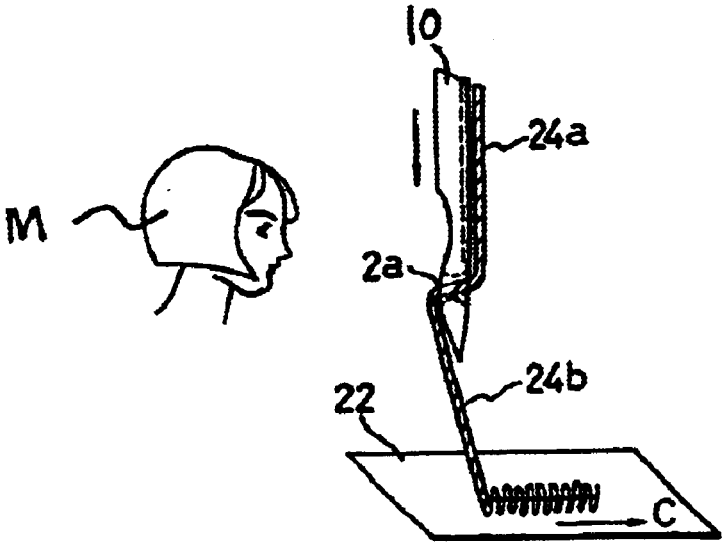

Referring to FIGS. 3A and 3B, there are shown top views illustrating the positional relationship between needle thread 24, needle eye 2*a*, direction of threading into the needle eye 2*a*, and the position of an operator M in accordance with the prior art. Referring to FIGS. 3C and 3D, there are shown side views corresponding to FIGS. 3A and 3B, respectively. The needle eye 2*a* of needle 10 is threaded by a needle thread 24 which has a portion of the needle thread 24*a* which is positioned above the needle eye 2*a*, and a portion of needle thread 24*b* which is positioned below the needle eye 2*a*. Under such a positional relationship, when a workpiece 22 is fed in the direction of D, the needle thread portion 24*b* positioned below the needle eye 2*a* is positioned toward the operator's side M in relation to the needle's position as shown in FIGS. 3A and 3C. By contrast, when the workpiece 22 is fed in the direction of C, the needle thread portion 24*b* positioned below the needle eye 2*a* is positioned partly toward the rear side of the needle and away from the operator's side as shown in FIGS. 3B and 3D. Therefore, it is possible that the needle 10 sticks the needle thread portion 24*b* when the needle 10 descends, thereby cutting the needle thread 24.

Figure 4:
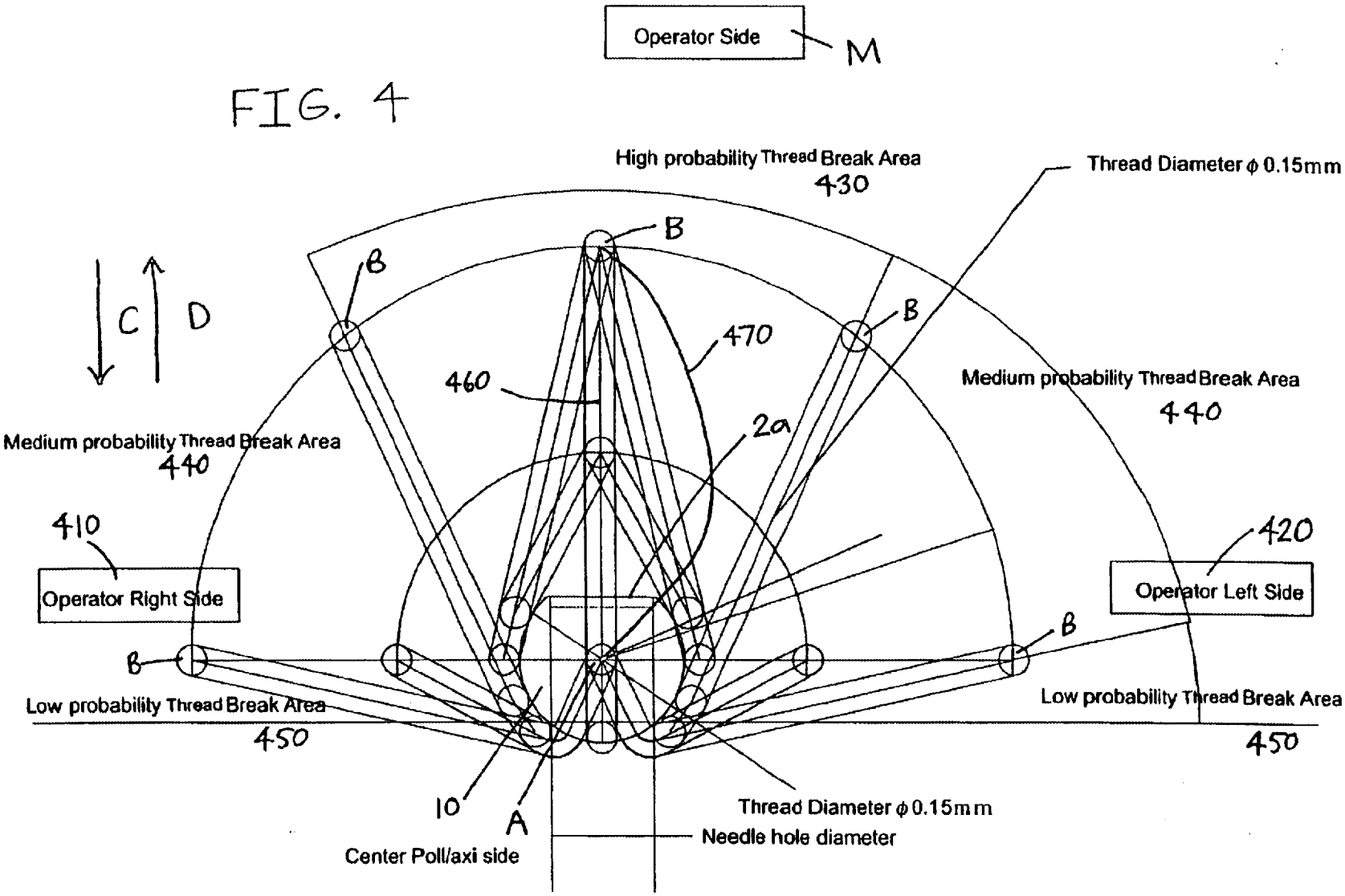
FIG. 4 is a top view illustrating an embroidery machine needle and areas about the needle of differing thread breakage probability in accordance with one embodiment of the invention.

Referring to FIG. 4, there is shown a top view illustrating an embroidery machine needle 10 and areas about the needle of differing thread breakage probability in accordance with one embodiment of the invention. As a workpiece 22 mounted on workpiece support table 3 is moved under the control of data processing system 200 in direction C, from a first needle penetration location A to a next needle penetration location B along a path 460, the probability of breakage of the needle thread 24 varies. The probability of needle thread breakage decreases as the location of the next needle penetration location B shifts to the left right side 410 or left side 420 of the operator M with respect to direction C and the needle eye 2*a*. The highest probability of breakage area 430 is aligned with direction C and the needle eye 2*a*. Areas of decreasing probability of thread breakage 440, 450 are found to the left and right of direction C and the needle eye 2*a*.

Referring to FIGS. 1A through 4, according to the present invention, sequences of instructions are stored in the memory 230 of data processing system 200 to control stepping motors 7 and 8 through interface 250 to move workpiece 22 mounted on workpiece support table 3 from the first needle penetration location A to the next needle penetration location B along an indirect path 470. By moving the workpiece 22 along an indirect path 470 between needle penetration locations A, B, the needle thread portion 24*b* positioned below the needle eye 2*a* is guided away from the needle point thus preventing breakage by the needle point upon penetration of the workpiece 22 by the needle 10 during stitching.

Figure 5:
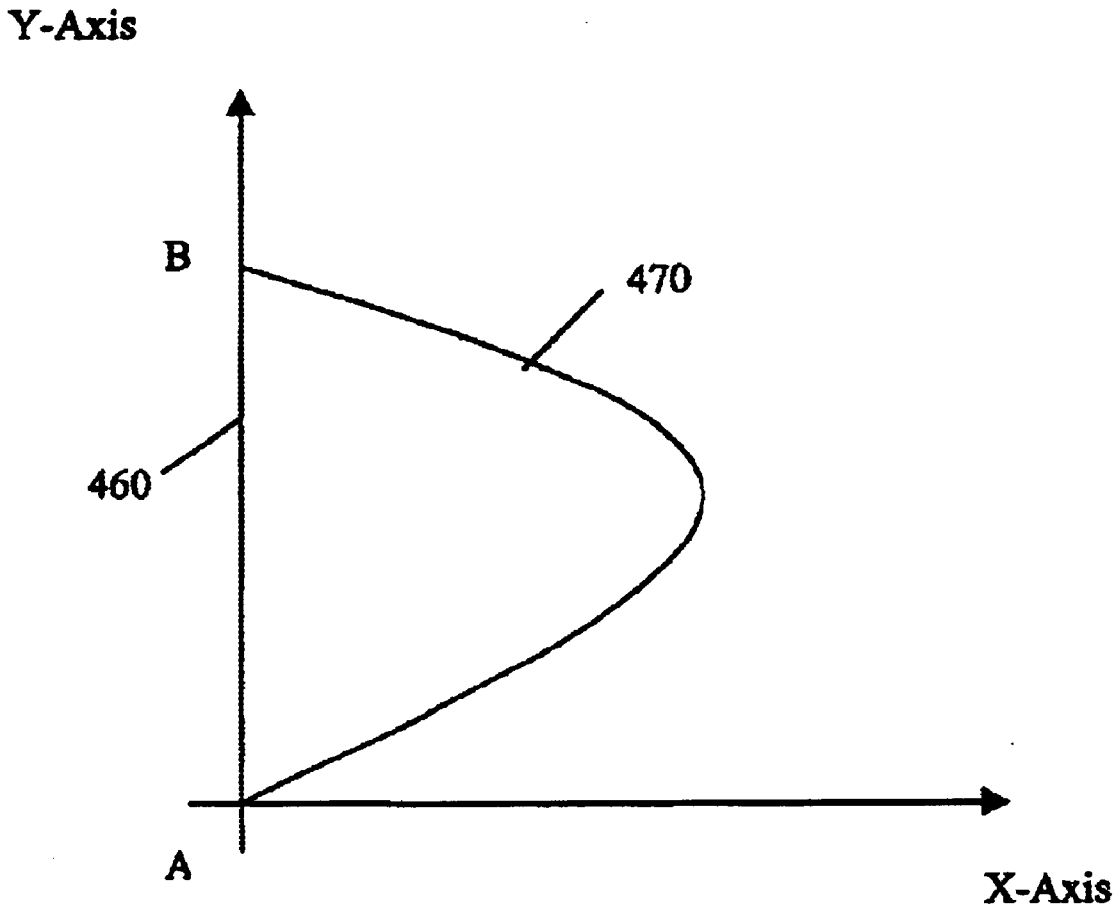
FIG. 5 is a graph illustrating direct and indirect paths for workpiece movement between needle penetration locations in accordance with one embodiment of the invention; and, FIG. 6 is a flow chart illustrating a general method for guiding a needle thread for an automated embroidery machine to prevent breakage of the needle thread by the point of the needle according to one embodiment of the invention.

Referring to FIG. 5, there is shown a graph illustrating direct and indirect paths 460, 470 for workpiece movement between needle penetration locations A, B in accordance with one embodiment of the invention. In FIG. 5, first needle penetration location A is shown at the origin of the x and y axes in the plane of the workpiece 22. Next needle penetration location B is shown at a point along the y-axis. In effect, the selection of an indirect path 470 introducing a component of movement to the path from A to B along the x-axis. This movement along the x-axis allows needle thread portion 24*b* to slide along the needle below the needle eye 2*a* away from the needle point. In this way, the needle thread portion 24*b* positioned below the needle eye 2*a* is guided away from the needle point thus preventing breakage by the needle point upon penetration of the workpiece 22 by the needle 10 during stitching.

Selection of an indirect path 470 is optional. In addition, the shape of the indirect path 470 is variable. The data processing system 200 determines the need for an indirect path based on factors including the location of needle penetration locations A, B relative to the direction of threading through the needle eye 2*a*. Typically, an indirect path 470 would be selected by the data processing system 200 for next needle penetration locations B lying in areas of high probability of needle thread breakage 430 as illustrated in FIG. 4. The data processing system 200 may determine the shape of the indirect path 470 based on factors including the probability of needle thread breakage. Thus, for next needle penetration locations B lying in a high probability of needle thread breakage area 430 the degree of distortion of the indirect path 470 may be greater than the degree of distortion of the indirect path for next needle penetration locations B located in areas of decreasing probability of needle thread breakage 440, 450. The shape of the indirect path 470 is variable and may include sinusoids, curves, arcs, and straight lines. Other factors in determining the need for an indirect path and the shape of the indirect path include thread tension, thread strength, thread diameter, stitch length, workpiece thickness, workpiece material, sewing speed, acceleration, speed of movement, and the distance between the needle point and the workpiece. Note that it is important to keep the needle thread straight.

Figure 6:
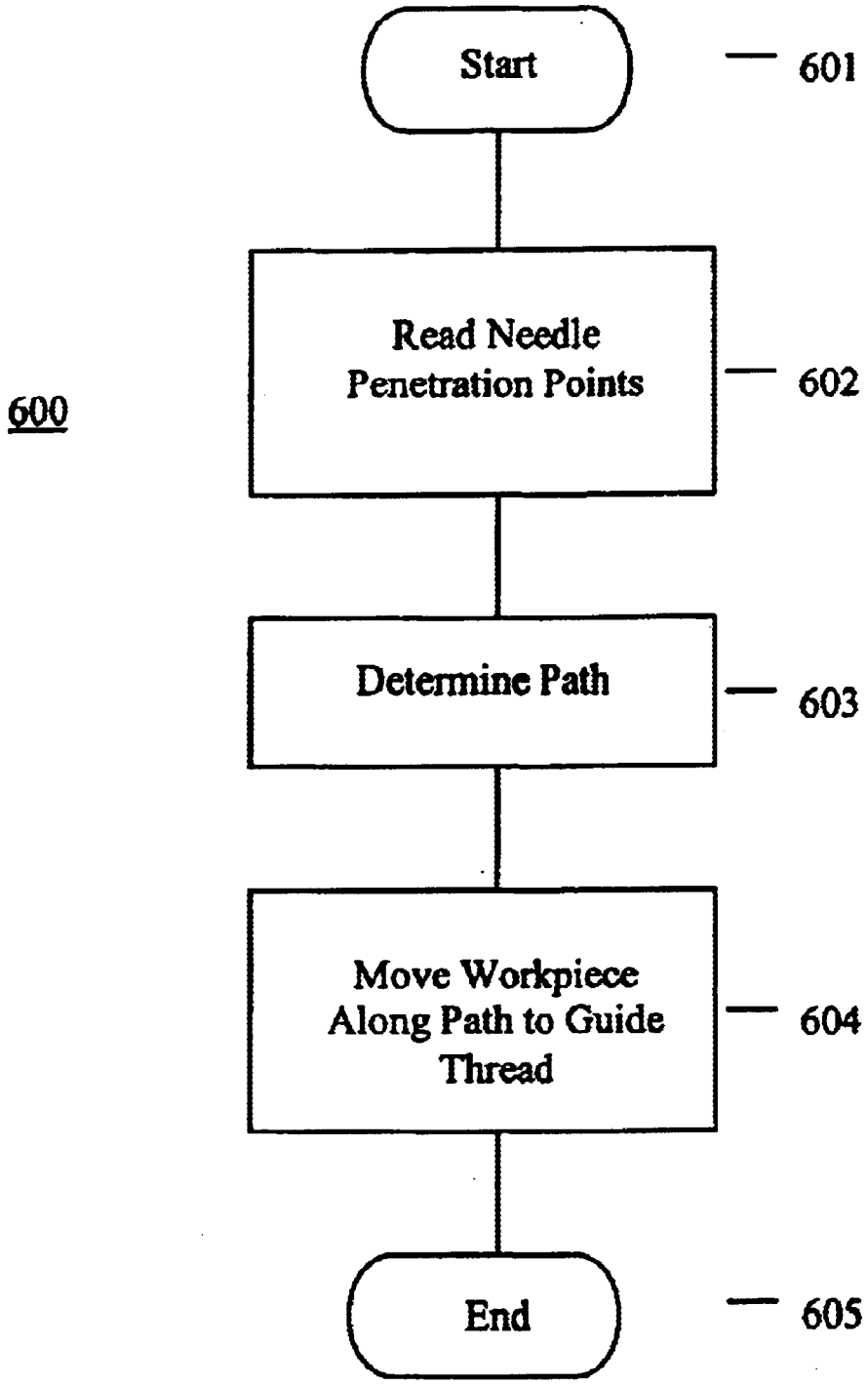

Referring to FIG. 6, there is shown a flow chart illustrating a general method for guiding a needle thread 24 for an automated embroidery machine 1, the needle thread 24 extending between the eye of a needle 2*a* and a workpiece 22 being stitched when the needle 10 is above the workpiece 22, to prevent breakage of the needle thread 24 by the point of the needle upon penetration of the workpiece 22 by the needle 10 during stitching, according to one embodiment of the invention. In FIG. 6, the flow chart is shown generally by numeral 600. At step 601, the method starts. At step 602, a first needle penetration location and a next needle penetration location are read. At step 603, a path for movement of the workpiece 22 between the first needle penetration location A and the next needle penetration location B is determined, wherein the path is selectively indirect. This step of determining a path can include the following: determining a probability of needle thread breakage for a direct path 460 between the first needle penetration location A and the next needle penetration location B; and, selecting an indirect path 470 if the probability is within a predetermined range. At step 604, the workpiece 22 is moved along the path 460, 470 from the first needle penetration location A to the next needle penetration location B, thereby guiding the needle thread 24 away from the needle point. At step 605, the method ends.

Although the invention has been described with reference to certain specific embodiments, various modifications thereof will be apparent to those skilled in the art without departing from the spirit and scope of the invention as outlined in the claims appended hereto.

I claim:

1. A method for minimizing contact between a needle point and needle thread in a computer controlled embroidery machine, to prevent breakage of said thread by said needle point upon penetration of a workpiece during stitching, said method comprising the steps of:

determining a first straight line path between a current needle penetration location and a next needle penetration location;

determining a probability of needle thread breakage for said first straight line path;

selecting a second non-straight path if said probability is within a predetermined range; and, moving to said next needle penetration location along said second non-straight path so that said needle thread is pulled away from said needle point.

2. The method of claim 1 wherein said second non-straight path has a variable shape.

3. The method of claim 2 wherein said shape includes sinusoids, curves, arcs, and straight lines.

4. The method of claim 3 wherein said shape is modified in response to variables including at least one of thread tension, thread strength, thread diameter, stitch length, workpiece thickness, workpiece material, sewing speed, acceleration, speed of movement, and distance between said needle point and said workpiece.

5. A method for minimizing contact between a needle point and needle thread in a computer controlled embroidery machine, to prevent breakage of said thread by said needle point upon penetration of a workpiece during stitching, said method comprising the steps of:

determining a first straight line path between a current needle penetration location and a next needle penetration location; and, moving to said next needle penetration location along a second non-straight path so that said needle thread is pulled away from said needle point;

wherein said second non-straight path has a variable shape;

wherein said shape includes sinusoids, curves, arcs, and straight lines; and, wherein said shape is modified in response to variables including at least one of thread tension, thread strength, thread diameter, stitch length, workpiece thickness, workpiece material, sewing speed, acceleration, speed of movement, and distance between said needle point and said workpiece.

6. The method of claim 5 and further comprising the steps of:

determining a probability of needle thread breakage for said first straight line path; and, selecting said second non-straight path if said probability is within a predetermined range.

7. A system for minimizing contact between a needle point and needle thread in a computer controlled embroidery machine, to prevent breakage of said thread by said needle point upon penetration of a workpiece during stitching, said system comprising:

a processor coupled to said embroidery machine for: determining a first straight line path between a current needle penetration location and a next needle penetration location; determining a probability of needle thread breakage for said first straight line path; selecting a second non-straight path if said probability is within a predetermined range; and, controlling said embroidery machine to move said needle point to said next needle penetration location along said second non-straight path so that said needle thread is pulled away from said needle point.

8. The system of claim 7 wherein said second non-straight path has a variable shape.

9. The system of claim 8 wherein said shape includes sinusoids, curves, arcs, and straight lines.

10. The system of claim 9 wherein said shape is modified in response to variables including at least one of thread tension, thread strength, thread diameter, stitch length, workpiece thickness, workpiece material, sewing speed, acceleration, speed of movement, and distance between said needle point and said workpiece.

11. A system for minimizing contact between a needle point and needle thread in a computer controlled embroidery machine, to prevent breakage of said thread by said needle point upon penetration of a workpiece during stitching, said system comprising:

a processor coupled to said embroidery machine for: determining a first straight line path between a current needle penetration location and a next needle penetration location; and, controlling said embroidery machine to move said needle point to said next needle penetration location along a second non-straight path so that said needle thread is pulled away from said needle point; wherein said second non-straight path has a variable shape; wherein said shape includes sinusoids, curves, arcs, and straight lines; and, wherein said shape is modified in response to variables including at least one of thread tension, thread strength, thread diameter, stitch length, workpiece thickness, workpiece material, sewing speed, acceleration, speed of movement, and distance between said needle point and said workpiece.

12. The system of claim 11 wherein said processor is further adapted for: determining a probability of needle thread breakage for said first straight line path; and, selecting said second non-straight path if said probability is within a predetermined range.

13. A computer program product having a computer readable medium tangibly embodying computer executable code for directing a computer controlled embroidery machine to minimize contact between a needle point and needle thread to prevent breakage of said thread by said needle point upon penetration of a workpiece during stitching, said computer program product comprising:

code for determining a first straight line path between a current needle penetration location and a next needle penetration location;

code for determining a probability of needle thread breakage for said first straight line path;

code for selecting a second non-straight path if said probability is within a predetermined range; and, code for moving to said next needle penetration location along said second non-straight path so that said needle thread is pulled away from said needle point.

14. The computer program product of claim 13 wherein said second non-straight path has a variable shape.

15. The computer program product of claim 14 wherein said shape includes sinusoids, curves, arcs, and straight lines.

16. The computer program product of claim 15 wherein said shape is modified in response to variables including at least one of thread tension, thread strength, thread diameter, stitch length, workpiece thickness, workpiece material, sewing speed, acceleration, speed of movement, and distance between said needle point and said workpiece.

17. A computer program product having a computer readable medium tangibly embodying computer executable code for directing a computer controlled embroidery machine to minimize contact between a needle point and needle thread to prevent breakage of said thread by said needle point upon penetration of a workpiece during stitching, said computer program product comprising:

code for determining a first straight line path between a current needle penetration location and a next needle penetration location; and, code for moving to said next needle penetration location along a second non-straight path so that said needle thread is pulled away from said needle point;

wherein said second non-straight path has a variable shape;

wherein said shape includes sinusoids, curves, arcs, and straight lines; and, wherein said shape is modified in response to variables including at least one of thread tension, thread strength, thread diameter, stitch length, workpiece thickness, workpiece material, sewing speed, acceleration, speed of movement, and distance between said needle point and said workpiece.

18. The computer program product of claim 17 and further comprising:

code for determining a probability of needle thread breakage for said first straight line path; and, code for selecting said second non-straight path if said probability is within a predetermined range.

* * * * *